United States Patent [19]

Hosford et al.

[11] 4,046,084

[45] Sept. 6, 1977

[54] FOLDING STOOL AND TABLE

[76] Inventors: Charles D. Hosford; Barry Simpson, both of Dirt Road Rural Delivery 1, Box 122, Waitsfield, Vt. 05673

[21] Appl. No.: 770,707

[22] Filed: Feb. 22, 1977

[51] Int. Cl.[2] ..... A47B 3/00; F16M 11/38

[52] U.S. Cl. ..... 108/112; 248/167; 312/258

[58] Field of Search ..... 297/17, 42, 43, 44; 312/258; 108/112, 113, 115, 118, 153; 248/163, 164, 432, 165, 166, 167, 170, 152, 459, 464, 463; 211/149, 169, 178; 16/150; D6/22, 27; 206/45, 45.26

[56] References Cited

U.S. PATENT DOCUMENTS

| | | | |
|---|---|---|---|
| 118,479 | 8/1871 | Parker | 248/167 X |
| 118,480 | 8/1871 | Parker | 108/112 |
| 390,340 | 10/1888 | Brower | 108/112 |
| 392,407 | 11/1888 | Chorman | 108/112 |
| 502,778 | 8/1883 | Shrague et al. | 312/258 |
| 965,194 | 7/1910 | Karbiner | 248/167 |
| 2,219,524 | 10/1940 | Lindley et al. | 16/150 X |

*Primary Examiner*—James T. McCall
*Attorney, Agent, or Firm*—Cesari and McKenna

[57] ABSTRACT

An article of folding furniture such as a stool or a table is made from board or other sheet material by a few cutting operations that provide substantially all the load bearing parts necessary for the complete unit. When assembled, the furniture article exhibits symmetry about the folding axis and its parts complement one another so that when the article is folded, the parts interfit to form a flat compact package. Resultantly, the article can be stored singly in a confined space or in numbers in a compact stack.

11 Claims, 7 Drawing Figures

FOLDING STOOL AND TABLE

BACKGROUND OF THE INVENTION

This invention relates to furniture. It relates more particularly to an article of furniture such as a stool or table which can be folded when not in use.

There are numerous conventional furniture articles that can be folded so that they occupy a minimum amount of storage space. However, these prior articles have certain drawbacks which militate against their wider use and application. Some comprise a relatively large number of intricate parts which are difficult and therefore expensive to manufacture. Other folding furniture articles require assembly by relatively skilled personnel because their various parts must be juxtaposed and glued in order to form the finished article. These articles are also relatively expensive. Still other articles of folding furniture have a soft top unsuitable for standing or placing objects upon, or are not sturdy and rugged enough to withstand normal usage. Consequently they have a relatively short useful life.

SUMMARY OF THE INVENTION

Accordingly the present invention aims to provide an article of furniture such as a stool or table that is fabricated easily from sheet or board material by a few simple operations that can be carried out quickly, easily and with great accuracy even by relatively unskilled personnel.

Another object of the invention is to provide a stool, table or similar article of manufacture which can be folded completely flat so that it can be stored singly in a confined space or in numbers in a compact stack or on a rack.

A further object of the invention is to provide a stool, table or similar furniture article which is lightweight, yet extremely sturdy so that it can support a relatively large weight.

Yet another object of the invention is to provide a folding stool or table which is composed of a relatively few different parts that are easy to assemble without requiring any special tools, glue or other such equipment.

A further object of the invention is to provide folding furniture such as a stool or table whose components can be sold in kit form for ready assembly by the purchaser.

Other objects will, in part, be obvious and will, in part, appear hereinafter.

The invention accordingly comprises the features of construction, combination of elements and arrangement of parts as exemplified in the following detailed description, and the scope of the invention will be indicated in the claims.

Briefly, an article of furniture such as a stool or table having a horizontal surface supported by legs is made from rigid sheet material by a few cutting or routing operations that provide substantially all the load bearing parts for the article. These parts are shaped and arranged to complement one another so that they interfit forming a flat compact package that can be shipped at relatively low cost. Also when the parts are fully assembled, the resultant furniture article is symmetric about the folding axis and folds flat so that it can easily be carried and be stored in a confined space.

Each furniture article comprises only three different sheet material parts, which parts are duplicated only once. More particularly, there are a pair of generally triangular pieces, a pair of generally C-shaped pieces and a pair of V-shaped pieces having bulbous noses. As cut from the sheet material, the three pieces in each set interfit and supplement one another to form a square. Aside from the six pieces of sheet material, each furniture article includes only a dowel, a few fasteners and a pair of canvas/wood hinge structures to be described in detail later.

One of the two C-shaped pieces is reversed and overlapped against the other and their arms are secured together forming a rectangular leg structure having a large central opening.

The V-shaped pieces are similarly reversed and secured together forming a second leg structure, pivotally mounted in that opening by means of a hinge extending along the vertical axes of the two leg structures. The two leg structures together are symmetric about the pivot axis and they complement one another so that when they are folded together, their parts interfit so as to lie substantially in a common plane. On the other hand, when the two leg structures are oriented at right angles to one another in their open position, they form a sturdy, stable upstanding support structure whose upper edges and whose lower edges lie in common planes.

The two triangular pieces of sheet material are positioned opposite one another and their base corners are hinged to the upper edges of the two C-shaped pieces comprising the first leg structure. These pieces can be swung from an open, generally horizontal position wherein their apexes overlie and are supported by the second leg structure when that is in its open position, to a folded, generally vertical position wherein they lie flush against one another so as to be coplanar with the folded-together leg structures.

The present furniture article thus comprises only a few different parts which are easily fabricated and assembled even by an unskilled person. When assembled, they form a very rugged, long-lived furniture article that can be folded completely flat for transportation or storage purposes. Yet with all of these advantages the units are relatively inexpensive because of the ease with which they are fabricated and assembled.

For purposes of illustration, we will describe the invention in terms of a folding stool. It will be appreciated however, that the same principles can be followed to make a folding table, or other folding furniture article composed of a platform supported above the floor or ground.

BRIEF DESCRIPTION OF THE DRAWINGS

For a fuller understanding of the nature and objects of the invention, reference should be had to the following detailed description, taken in connection with the accompanying drawings, in which.

DESCRIPTION OF THE PREFERRED EMBODIMENT

Figure 1:
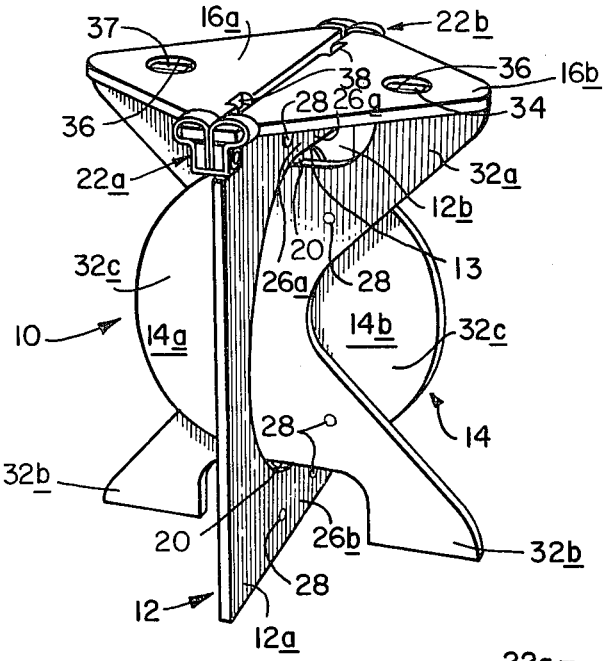
FIG. 1 is a perspective view of a folding stool made in accordance with this invention.
Figure 2:
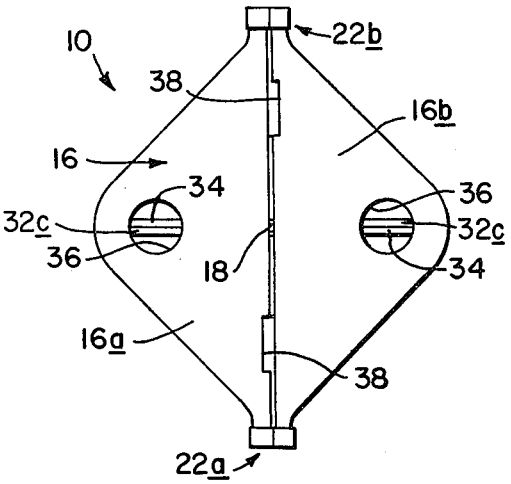
FIG. 2 is a top plan view thereof.

Referring now to FIGS. 1 to 5 of the drawings, the folding stool indicated generally at 10 is constructed for the most part of relatively thin, hard, impact resistant sheet stock such as plastic, particle board or most preferably a good grade of hardwood plywood. It comprises upstanding support structure consisting of a thin, generally rectangular leg structure 12 extending the entire width of the stool. Mounted in a generally circular opening 13 in the center of leg 12 is additional leg structure shown generally at 14 having the general shape of an X. The two leg structures 12 and 14 complement one another and they are pivotally connected together by a dowel 18 received in a passage 19 extending vertically from the top of leg structure 12 through leg structure 14 to the bottom of leg structure 12. Thus leg structure 14 can swing on dowel 18 from an open position shown in FIG. 1 wherein it is oriented substantially at right angles to leg structure 12 to a closed position shown in FIG. 5 wherein structure 14 is substantially coplanar with leg structure 12. A pair of leather washers 20 (FIGS. 1 and 6) engage around dowel 18 at points above and below structure 14 to maintain the structures 12 and 14 in vertically spaced relation and ensure their free pivotal movement.

Figure 4:
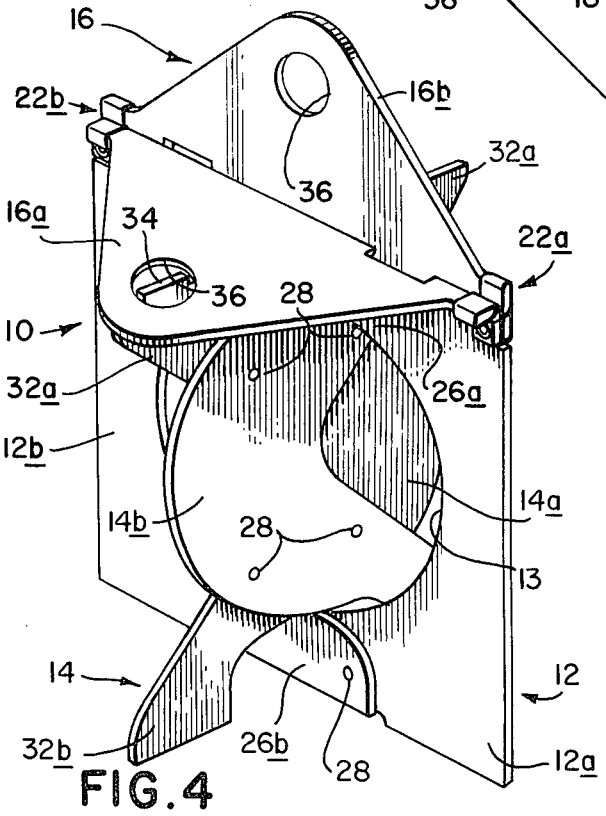
FIG. 4 is a perspective view of the FIG. 1 stool viewed from a different angle and in a partially folded position.
Figure 5:
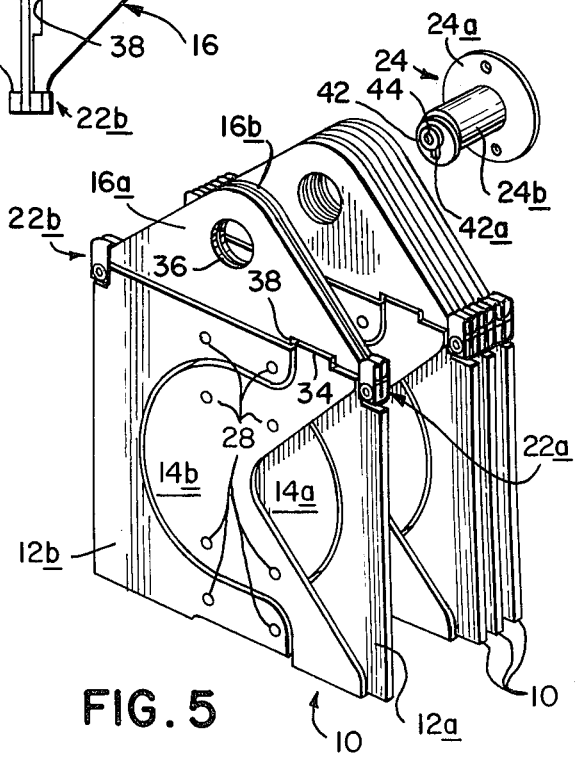
FIG. 5 is a similar view of the FIG. 1 stool in its fully folded position juxtaposed with several similar folded stools on a wall bracket.

The upstanding leg structures 12 and 14 support a horizontal seating platform indicated generally at 16. The platform 16 is generally rectangular, being composed of two similar triangular sections 16*a* and 16*b*. Each of these sections is connected at their base corners by hinge structures 22*a* and 22*b* to the upper two corners of leg structure 12 so that these sections can be swung from an open, generally horizontal position indicated in FIG. 1 to an upstanding folded position as shown in FIGS. 4 and 5. When the seating platform 16 is in its FIG. 1 open position, the apexes of the triangular sections 16*a* and 16*b* overlie and are supported by the upper arms of the X-shaped leg structure 14 when that is in its open position. Thus structure 14 functions as a truss that transmits any downward forces on sections 16*a* and 16*b* directly to the ground. On the other hand, the base edges of section 16*a* and 16*b* are supported by leg structure 12 which also transmits downward forces on the seating platform 16 directly to the ground. Since the material of which the stool is fabricated has excellent compressive strength, the stool is able to support weights as high as 600 lbs. evenly distributed over the seating platform 16.

When the stool is in its folded position illustrated in FIG. 5, the leg structures 12 and 14 interfit and the upwardly extending platform sections 16*a* and 16*b* lie flush against one another in the same plane as the leg structures so that the folded stool forms a flat, compact package that can be carried easily and be stored or stacked in automobiles or recreational vehicles where space is quite limited. Alternatively it can be suspended from a suitable wall bracket 24 (FIG. 5).

Figure 6:
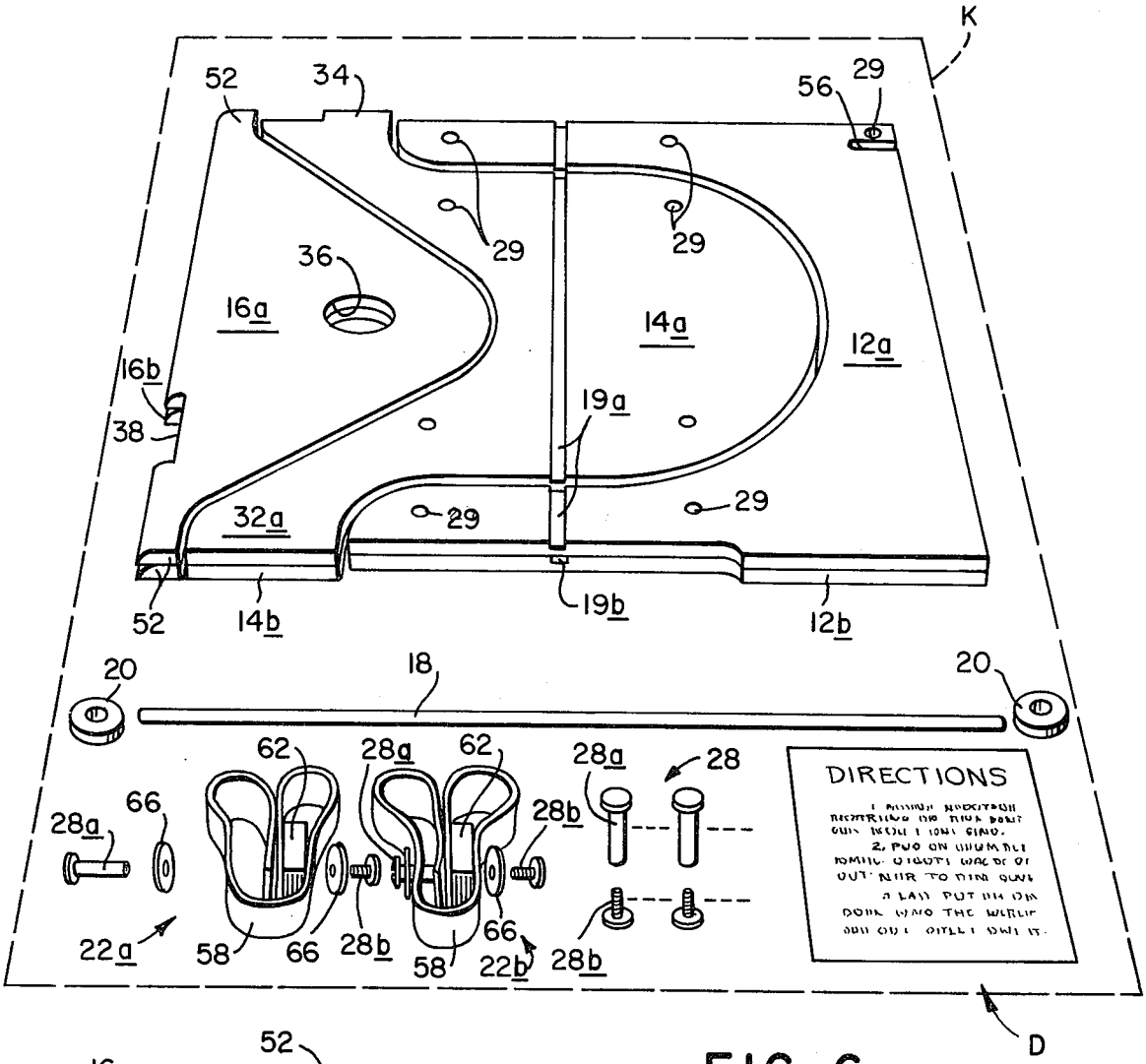
FIG. 6 is a perspective view on a larger scale of the various components for making the FIG. 1 stool arranged in a kit.

Referring now to FIGS. 1 and 4, the leg structure 12 comprises a pair of identical C-shaped sections 12*a* and 12*b*, each section having an upper arm 26*a* and a lower arm 26*b*. One section is reversed with respect to the other and its upper and lower arms superimposed on the corresponding arms of the other section forming the circular opening 13 referred to above. In other words the two sections are overlapping mirror images of one another. The upper and lower arms are secured together by pairs of fasteners 28 extending through appropriately spaced predrilled openings 29 in those arms (FIG. 6). Suitable fasteners 28 are shown in FIG. 6 as brass channel post screws comprising mating male and female elements 28*b* and 28*a* respectively.

The leg structure 14 comprises a pair of identical generally V-shaped sections 14*a* and 14*b*. Each of these sections has an upper arm 32*a* which extends up and supports one section of the seating platform 16 and a lower arm 32*b* that extends down to the ground. Intermediate the two arms, is a rounded bulbous portion 32*c* whose radius is slightly smaller than the radius of opening 13 in leg structure 12. One of the sections 14*a* and 14*b* is reversed and positioned flush against the other similar section in overlapping mirror image fashion so that their rounded portions 32*c* together form a substantially circular disk. The two sections 14*a* and 14*b* are also secured together by fasteners 28 extending through appropriate openings 29 in those sections.

The passage 19 accommodating dowel 18 is actually formed by opposing channels 19*a* and 19*b* extending the lengths of the complementary leg structure sections from each section pair as best seen in FIG. 6. The dowel 18 is inserted between the sections prior to tightening fasteners 28. Since the length of dowel 18 captured between sections 14*a* and 14*b* is substantially greater than the lengths captured between the upper and lower ends of sections 12*a* and 12*b*, the dowel tends to pivot in the latter sections.

Figure 3:
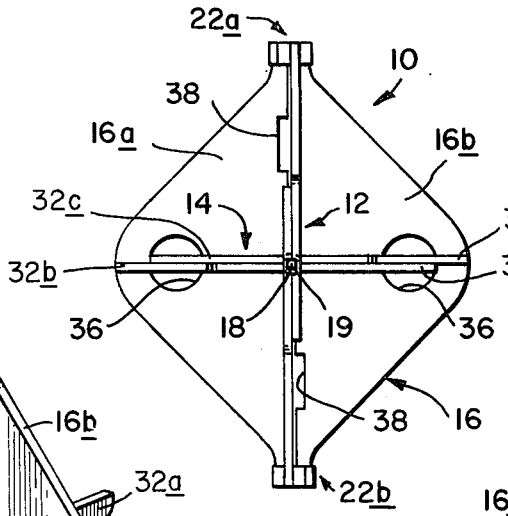
FIG. 3 is a bottom plan view thereof.

The lower edges of leg sections 14*a* and 14*b* are coplanar with the lower edges of sections 12*a* and 12*b* so that together the leg structures form a sturdy, stable and erect support for the seating platform 16. The upper edges of the leg section 14*a* and 14*b* also define coplanar surfaces that bear against the platform sections 16*a* and 16*b*. Further each such edge is formed with an upstanding tab 34 that is snugly received in a round opening 36 in the overlying seating platform section 16*a*, 16*b* when the stool is in its open or unfolded position. The engagement of the tabs in the openings thus locks the leg structure 12 in its open position wherein it is disposed at right angles to leg structure 14 as best seen in FIG. 3. This feature ensures that the stability of the stool is maintained even though the stool may be shifted about in use. The tab-opening engagement also helps to minimize stresses on the leg structure 14 because it inhibits the spreading-apart of the arms of that X-shaped structure when weight is applied to platform 16.

The seating platform section 16*a*, 16*b* are also substantially identical, one being rotated or reversed about a horizontal axis (FIG. 1) relative to the other. Each section conforms to the V-shaped cutout in leg structure sections 14*a*, 14*b*. Also in addition to opening 36, each section 16*a* and 16*b* is formed with a notch 38 in its base edge for accommodating the tab 34 on the underlying leg structure sections 14*a*, 14*b* when the stool is in its folded position illustrated in FIG. 5.

Figure 7:
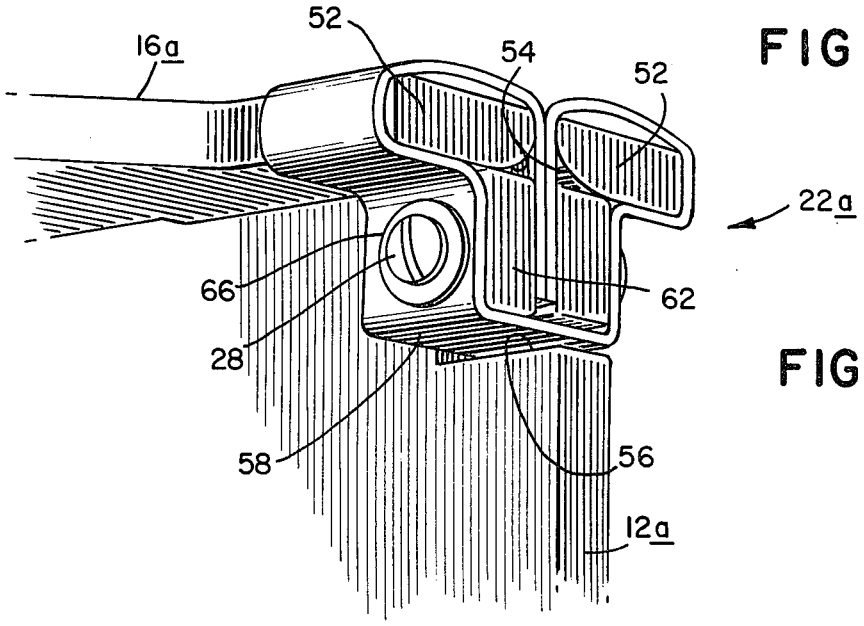
FIG. 7 is a fragmentary perspective view on a still larger scale showing a hinge of the FIG. 1 stool in greater detail.

Referring for a moment to FIG. 7, the hinge structures 22*a* and 22*b* retaining platform sections 16*a*, 16*b* are identical. Therefore we will describe only the hinge structure 22*a* in detail. Structure 22*a* is actually a double hinge that connects the corresponding ends of seating platform sections 16*a* and 16*b* to the leg structure section 12*a*. Each base corner of each section 16*a*, 16*b* terminates in a laterally extending generally rectangular tongue 52. The sides of tongues 52 that face one another above leg section 12*a* are rounded or beveled at 54. Also a slot 56 is formed in leg section 12*a* that extends in from the side edge of that section near the top thereof. Slot 56 accommodates the width of a strip 58 of strong, flexible material such as nylon webbing.

The tongue 52 of the seat section 16*b* is positioned on the upper edge of section 12*a* directly above slot 56. The corresponding tongue 52 of platform section 16*a,* on the other hand, rests on a small square wooden block 62 whose height corresponds to the distance between the top edge of section 12*a* and slot 56. The block 62 provides the thickness at the hinge structure 22*a* to support the platform section 16*a.* The webbing strip 58 is received in slot 56 and extends up around the outer faces of section 12*a* and block 62 up and over tongues 52 and then down between the tongues and between the inner faces of section 12*a* and block 62. The strip is pulled taut and retained by a fastener 28 inserted through the strip 58 and through predrilled openings 29 in section 12*a* and block 62. Desirably suitable brass washers 66 are provided adjacent the fastener heads to distribute stresses on the strip over larger strip areas.

The strip 58 permits each platform section 16*a,* 16*b* to be swung from a generally horizontal position shown in FIGS. 1 and 7 to a vertical position illustrated in FIG. 5 with the beveled sides 54 of the two tongues 52 bearing against the upper surfaces of leg structure section 12*a* and block 62. The strip 58 permits each tongue 52 to slidably rotate within the loop formed by the strip, yet it securely anchors each tongue 52 to section 12*a.*

The hinge structure 22*b* is identical in that a slot 56 is formed in the leg structure section 12*b* for accommodating a second webbing strip 58. Another block 62 is positioned adjacent section 12*b* and the protruding beveled tongues 52 at the opposite ends of platform sections 16*a,* 16*b* are hingedly secured by strip 58 to leg section 12*b,* the strip being anchored by another fastener 28.

The bracket 24 shown in FIG. 5 is a particularly desirable means to facilitate storing several stools 10. It comprises simply a circular wooden base 24*a* whose radius is substantially the same as the radius of the apexes of the seating platform sections 16*a* and 16*b.* Projecting out from base 24*a* is a cylindrical peg 24*b* whose radius is slightly less than that of the openings 36 in sections 16*a* and 16*b* so that it fits snugly in openings 36 with the tops of the aforementioned apexes conforming to the contour of the base 24*a* as illustrated in FIG. 5.

In order to prevent the folded stools from becoming dislodged inadvertently from bracket 24, a disk 42 having a vertical slot 42*a* is secured to the end of peg 24*b* by means of a screw 44. The diameter of the disk 42 is identical to that of peg 24*b.* The slot is arranged so that the disk can assume two different positions relative to the peg. When one end of the slot rests on the screw, the disk is concentric with the peg so that stools can be slid on and off the peg. When the other end of slot 42*a* rests on peg 24*b,* the disk 42 is eccentric with respect to the peg thereby locking the stools on the bracket 24.

Turning now to FIG. 6, the wooden pieces 12*a,* 14*a* and 16*a* comprising the stool are conveniently formed from a single square piece of sheet material that is approximately 16½ inches on a side. In a typical manufacturing process, first the slot 19 is milled, then nine holes 29 are drilled in the piece of material at the illustrated locations. Next, in a continuous routing operation the perimeter of the sheet material is shaped as illustrated in FIG. 6 to form notch 38, tab 34, tongue 52, and slot 56 and to appropriately ease the edges on both sides of the sheet. Also the beveled surface 54 is formed during the routing step. It has a radius of approximately ¼ inch. Finally, by an interior routing operation, the three pieces are separated along a continuously curved cut approximately ¼ inch wide with the edges adjacent to cut being eased on both sides of the sheet.

The remaining three pieces 12*b,* 14*b* and 16*b* are shaped in the same way from a second similar square piece of material. Alternatively, using a high volume, tape controlled router, several sets of pieces can be formed in one continuous operation from a single long rectangular sheet of material in accordance with conventional milling procedures.

As seen in FIG. 6, the pieces of sheet material in each set supplement one another and the two sets can be stacked one on top of the other so that, in total, they occupy a minimum amount of space. The remaining components of the stool comprising the dowel 18, washers 20, hinge structures 22*a* and 22*b* and the fasteners 28 occupy very little additional space. Therefore all of these components along with a set of assembly instructions D can be sold in the form of a compact kit K.

Following instructions D, the purchaser can assemble the stool components quite quickly and easily, the only tool required being a conventional screw driver. Alternatively, the stool can be merchandized fully assembled since in its folded position the stool is completely flat. Thus it can be shipped singly or in sets in a container of relatively small size with the overall package being of relatively modest weight.

It will be seen from the foregoing, then, that the article of folding furniture described herein is constructed from a relatively few duplicative parts that are readily assembled without requiring any special tools or other equipment. When assembled, the parts coact and corporate to provide an article such as a stool or table which is extremely rugged and sturdy. Further, the furniture article can be folded completely flat so that one or more of the articles can be stored in a very confined space.

It will also be seen from the foregoing that the objects set forth above, among those made apparent from the preceding description are efficiently attained, and since certain changes may be made in the above construction without departing from the scope of the invention, it is intended that all matter contained in the above description or shown in the accompanying drawings be interpreted as illustrative and not in a limiting sense.

It is also to be understood that the following claims are intended to cover all of the generic and specific features of the invention herein described.

We claim:

1. An article of folding furniture comprising

A. a first upstanding leg structure made of rigid sheet material and having parallel top and bottom edges, B. means defining a central opening in the first structure, C. a second upstanding leg structure made of rigid sheet material and with parallel top and bottom edges, said second structure being positioned in said opening with the vertical axes of the two leg structures coinciding and with opposite side edges of the second structure being disposed on opposite sides of the first structure, D. means for pivotally connecting the two structures at their vertical axes so that the two structures are pivotable relative to one another about said axes from an open position wherein the two leg structures are disposed at right angles to one another to a closed position wherein the two leg structures are more or less flush against one another, E. a pair of similar platform sections made of rigid sheet material, and F. means for hinging corresponding edges of the platform sections to the upper edge of the first leg structure so that the platform sections are swingable from an open, generally horizontal position wherein they are engaged and supported by edges of the second leg structure to a folded position wherein they are disposed flush against one another directly above the leg structures when said structures are in their folded position whereby the leg structures and platform sections form a relatively flat, compact package.

2. The article defined in claim 1 wherein the first leg structure is generally rectangular and the second leg structure is generally X-shaped have upper and lower arms projecting out on opposite sides of the first leg structure.

3. The article defined in claim 2 wherein the platform sections are generally triangular with the base edges of the sections being hinged to the first leg structure and the apexes of the sections being supported by the arms of the second leg structure when that is in its open position whereby to form a generally square horizontal platform.

4. The article defined in claim 3 and further including coacting means on each platform section and on each upper arm of the second leg structure which interlock when the article is in its open position so as to prevent the leg structures from being moved inadvertently to their folded position.

5. The article defined in claim 4 wherein the coacting means comprise an opening in each platform section and an upwardly projecting tab on each upper arm of the second leg structure.

6. The article defined in claim 1,

A. wherein each leg structure comprises overlapping mirror image sections, and

B. further including means for securing together the sections in each leg structure so that the first and second leg structures together are symmetric about the pivot axis with their sections complementing one another so that when the two leg structures are moved to their folded position, their sections interfit so that the sections in one structure are coplanar with the sections in the other structure.

7. The article defined in claim 6 wherein the platform sections are generally triangular with the opposite base edges of the sections being hinged to corresponding points on the first leg structure sections and the apexes of the platform sections overlying the second leg structure sections when the article is in its open position, said platform sections being foldable flush against one another so as to be substantially coplanar with the first and second leg structure sections when the article is in its folded position.

8. The article defined in claim 7 wherein the first platform section and a section from each leg structure are shaped and arranged so they supplement one another to form a square whereby said sections can be cut from a single square piece of sheet material whose edge dimension is substantially equal to the height of the first leg structure section.

9. The article defined in claim 8 wherein

A. each section in the first leg structure is generally C-shaped so that when they are connected together they form a rectangle having a central circular opening, B. each section on the second leg structure is generally V-shaped with a rounded nose at the corner so that when the sections are secured together they form a circular disk whose radius is slightly less than that of the opening in the first leg structure with the arms of each section extending upwardly-outwardly and downwardly-outwardly from the disk.

10. The article defined in claim 9 wherein the connecting means comprises rod means extending along a vertical axes of the leg structures between the structure sections.

11. The article defined in claim 1

A. wherein the platform sections have corresponding openings which lie opposite one another when the sections are in their folded position, and B. further including means for hanging the article, said means including a projection arranged to engage in said openings.

* * * * *